US007788744B2

(12) United States Patent
Calilung et al.

(10) Patent No.: US 7,788,744 B2
(45) Date of Patent: Sep. 7, 2010

(54) SELF ROCKING SLEEPING COMPARTMENT ASSEMBLIES AND METHOD OF DRIVING THE SAME

(75) Inventors: Ryan Calilung, Chicago, IL (US); Edward B. Bretschger, Chicago, IL (US); Troy D. Mason, Brownsburg, IN (US)

(73) Assignee: Kolcraft Enterprises, Inc., Chicago, IL (US)

( * ) Notice: Subject to any disclaimer, the term of this patent is extended or adjusted under 35 U.S.C. 154(b) by 664 days.

(21) Appl. No.: 11/675,483

(22) Filed: Feb. 15, 2007

(65) Prior Publication Data

US 2008/0196164 A1 Aug. 21, 2008

(51) Int. Cl.
*A47D 9/02* (2006.01)

(52) U.S. Cl. ..... 5/109; 5/101; 5/105

(58) Field of Classification Search ..... 5/108–109, 5/101, 103, 106, 105
See application file for complete search history.

(56) References Cited

U.S. PATENT DOCUMENTS

| | | | | |
|---|---|---|---|---|
| 132,745 | A | 11/1872 | Batley | |
| 138,320 | A | 4/1873 | Doremus | |
| 177,649 | A | 5/1876 | McLean | |
| 1,132,432 | A | 3/1915 | Brzozowski | |
| 1,218,837 | A | 3/1917 | Christopher | |
| 1,727,635 | A | 9/1929 | Crane | |
| 2,283,000 | A | 5/1942 | Feldman | |
| 2,869,145 | A | 1/1959 | Gregory | |
| 2,979,735 | A | 4/1961 | Helmer | |
| 3,031,687 | A | 5/1962 | Stevens et al. | |
| 3,125,767 | A | 3/1964 | Griggs et al. | |
| 3,653,080 | A | 4/1972 | Hafele | |
| 3,737,924 | A | 6/1973 | Davis | |
| 4,080,673 | A | 3/1978 | Weisler | |
| 4,108,415 | A | 8/1978 | Hauray et al. | |
| 4,150,820 | A | 4/1979 | Bochmann | |
| 4,483,327 | A | 11/1984 | Graham et al. | |
| 4,615,059 | A | 10/1986 | Darowski | |
| 4,656,680 | A | 4/1987 | Wilson | |
| 4,881,285 | A | 11/1989 | Zeeb | |
| 4,911,499 | A | 3/1990 | Meeker | |
| 5,037,375 | A | 8/1991 | Gatts | |
| 5,845,350 | A | 12/1998 | Beemiller et al. | |
| 6,027,409 | A | 2/2000 | Favorito et al. | |
| 6,068,566 | A * | 5/2000 | Kim | 474/84 |
| 6,092,870 | A | 7/2000 | Desnoyers et al. | |
| 6,189,167 | B1 | 2/2001 | Tsai | |
| 6,378,940 | B1 | 4/2002 | Longoria et al. | |
| 6,966,082 | B2 | 11/2005 | Bloemer et al. | |
| 6,971,127 | B2 | 12/2005 | Richards | |
| 7,551,100 | B1 * | 6/2009 | Salley et al. | 340/692 |
| 2005/0144847 | A1 | 7/2005 | Liles | |

* cited by examiner

*Primary Examiner*—Fredrick Conley
(74) *Attorney, Agent, or Firm*—Hanley, Flight & Zimmerman, LLC

(57) ABSTRACT

Sleeping compartment support assemblies and methods of driving the same are disclosed to selectively provide reciprocating motion to a sleeping enclosure. An example sleeping compartment support has a drive mechanism that utilizes a rotary motor and a slider crank assembly to generate substantially planar motion in a generally horizontal plane.

22 Claims, 6 Drawing Sheets

SELF ROCKING SLEEPING COMPARTMENT ASSEMBLIES AND METHOD OF DRIVING THE SAME

FIELD OF THE DISCLOSURE

This disclosure relates generally to childcare products and, more particularly, to self rocking sleeping compartment assemblies and methods of driving the same.

BACKGROUND

It is common for infants to rest or sleep in a sleeping compartment, such as a bassinet, cradle or crib. Typically, the sleeping compartment is fixedly mounted and is intended to a support to remain stationary. However, some sleeping compartments are designed to move while holding an infant during rest, so as to sooth the child.

Some movable sleeping compartments are supported on assemblies that permit a person to push the sleeping compartment to rock the device back-and-forth. Others include a motor to propel the assembly in a swinging or rocking motion. Many prior sleeping compartments, such as bassinets, are constructed to rest on a floor surface and to be located adjacent the floor. Low positioning of sleeping compartments can be inconvenient for a person caring for an infant and may lead to back strain due to the bending and lifting required when placing a child into or removing a child from such sleeping compartments.

Automated rocking assemblies typically utilize a spring to capture some of the kinetic energy while damping the end of an upward stroke of the sleeping compartment and then to return the energy on a downward stroke, and/or they have a motor with a relatively large torque rating, due to the lifting involved in the vertical displacement of the mass (e.g., the sleeping compartment and the infant). However, the large, arcuate motions produced by these prior rocking assemblies are not well suited for gentle, reciprocating propulsion of a sleeping compartment, such as a bassinet.

Some sleeping compartments are designed with a relatively smaller range of motion and are propelled by a motor. These units typically use a series of solenoids or a motor capable of generating relatively high torque at a low speed, as well as resilient members, such as springs, to dampen movements at the end of each stroke of the device. Unfortunately, such components add significant cost and commonly require an AC power source to supply their power requirements.

DETAILED DESCRIPTION

Figure 1:
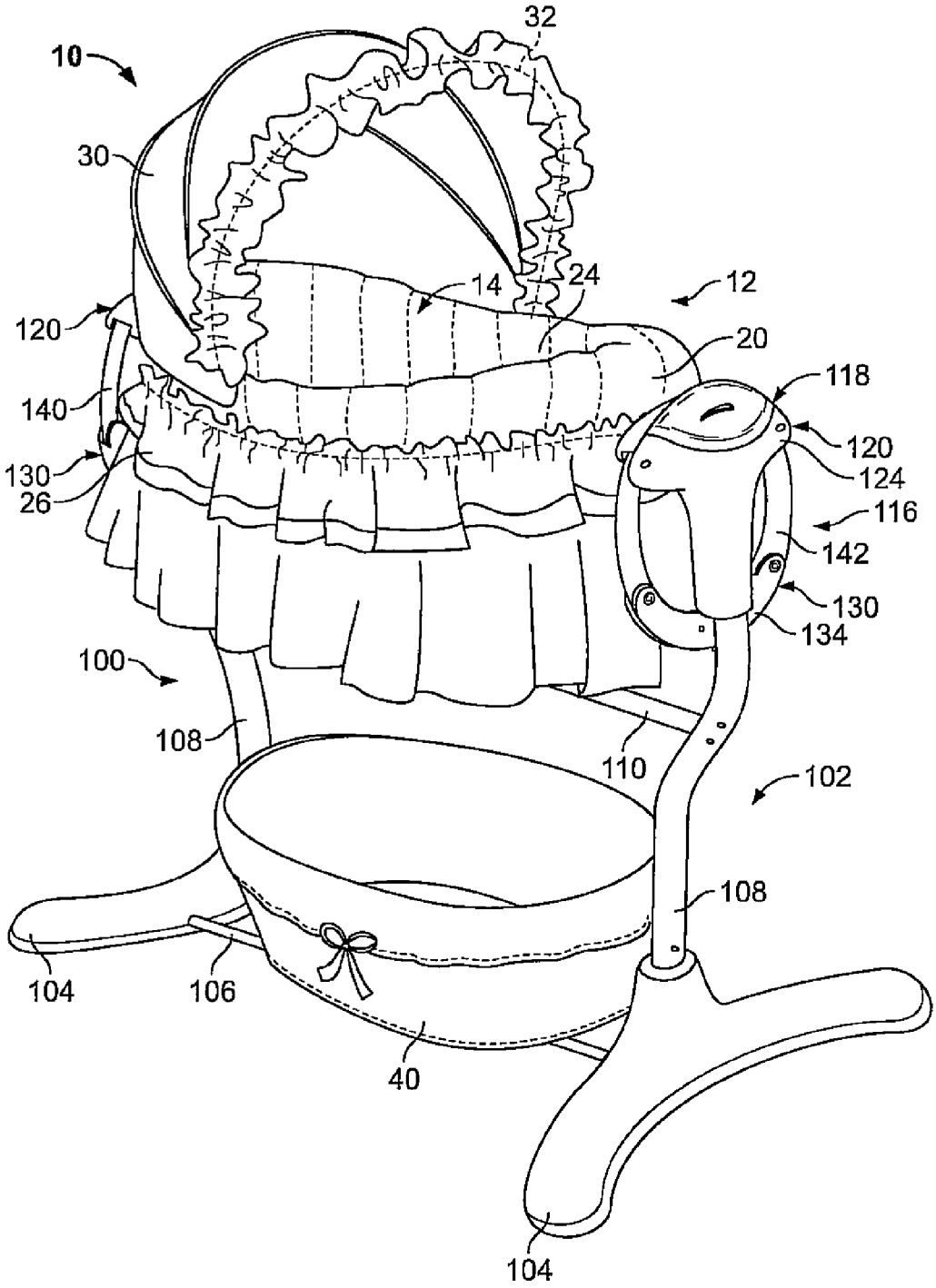
FIG. 1 is a perspective view of an example sleeping compartment support constructed in accordance with the teachings of the invention, shown with an example bassinet assembly.
Figure 2:
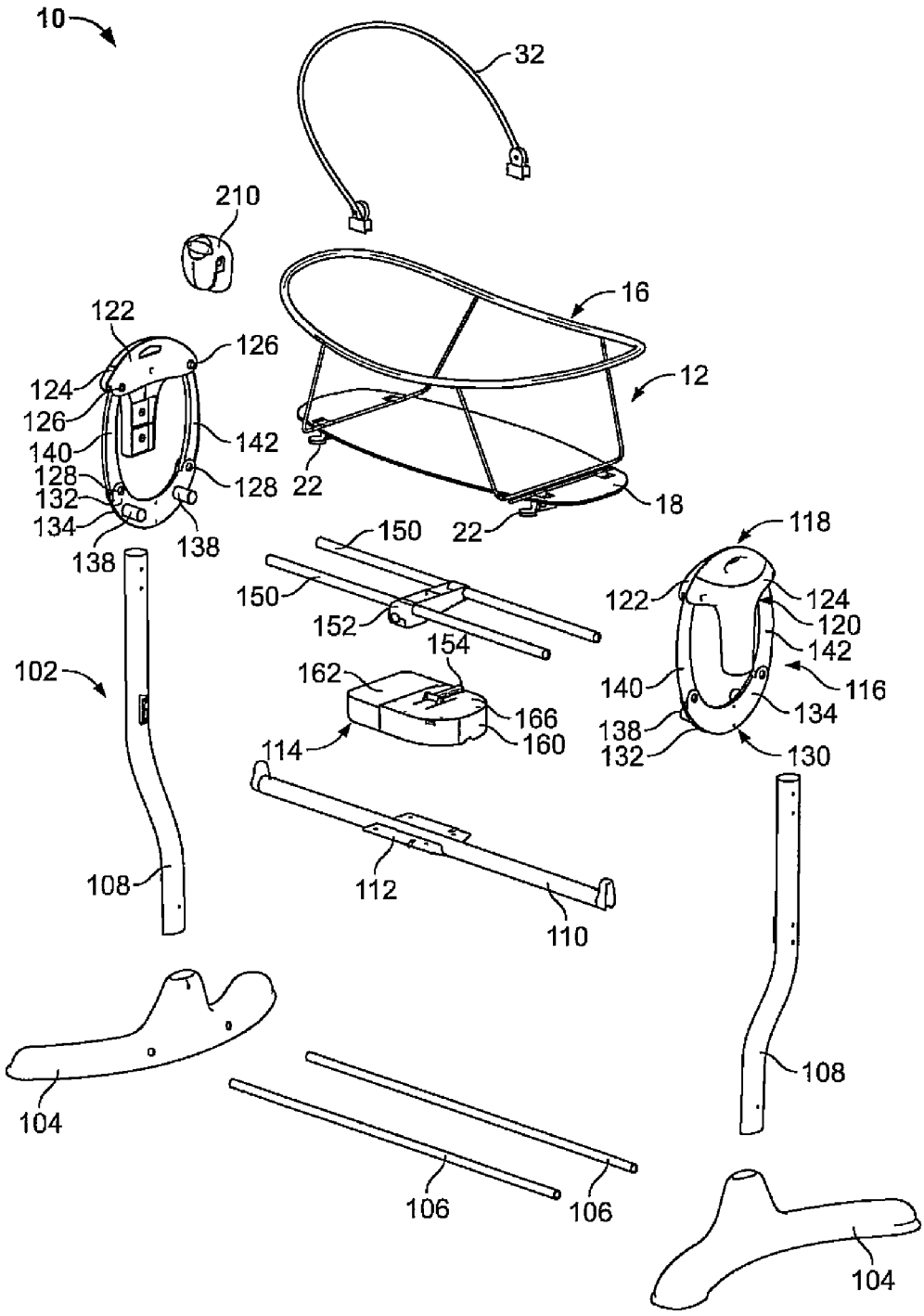
FIG. 2 is an exploded perspective view of the example sleeping compartment support shown in FIG. 1, shown with a the frame of the bassinet of FIG. 1 exposed.

Referring now to the drawings, FIGS. 1-6 show an example self rocking sleeping compartment assembly 10 that includes a sleeping enclosure 12 connected to a sleeping compartment support 100. In this illustrated example, as best seen in FIGS. 1 and 2, the sleeping enclosure 12 is shown as a bassinet having an elongated compartment 14, but other types and/or shapes of sleeping enclosure 12 would likewise be appropriate.

The bassinet 12 of the illustrated example is formed with an oval frame 16, a bottom panel 18, and a fabric enclosure 20. The underside of the bottom panel 18 is equipped with connectors 22 to removably engage the sleeping compartment support 100. The fabric enclosure 20 wraps over the frame 16, presenting a padded upstanding inner wall 24 and a decorative outer skirt 26. The example bassinet 12 of FIG. 1 also is shown with a canopy 30 having an adjustable, pivotal canopy stay 32. An optional lower basket 40 is shown for convenient additional storage, or for temporary use as a stationary removable sleeping compartment.

The sleeping compartment support 100 of the illustrated example is constructed and dimensioned to hold, and when desired, automatically move the sleeping compartment 12 in a side-to-side reciprocating or rocking motion. The support 100 has a stationary base 102 having a pair of base portions 104 to rest upon a ground surface. The sleeping enclosure 12 is suspended by the sleeping compartment support 100 at a convenient height from the ground, such as with the bottom panel 18 located approximately 30 inches above a ground surface, to avoid unnecessary bending and straining when lifting a child. The base portions 104 are connected to each other via a pair of lower bars 106. To provide adjustability for uneven ground surfaces, it will be appreciated that each base portion 104 may incorporate downward extending, height-adjustable feet (not shown).

The example base 102 of FIG. 1 also includes a pair of upward extending posts 108, each of which is slid downward into a respective base portion 104 and connected thereto with fasteners. The upward extending posts 108 of the illustrated example are connected to each other via an upper bar 110. The upper bar 110 enhances the stability of the posts 108. In the illustrated example, a mounting bracket 112 is connected to the upper bar 110 at a position located approximately midway between the posts 108. In the example shown in FIGS. 1-2, the mounting bracket 112 is used to connect a drive unit 114 to the upper bar 110. It will be appreciated that the base portions 104 may be formed of any type of material (e.g., molded plastic, stamped sheet metal or the like). Also, the lower bars 106, posts 108, and upper bar 110 may be formed from any type of material (e.g., solid or tubular plastic, metal, or the like). The connections between the various components of the base 102 may be made using mechanical or chemical fasteners, by welding, or by any other suitable connection means.

Movably connected to the stationary base 102 of the example sleeping compartment support 100 is an example carrier assembly 116. The example carrier assembly 116 of FIG. 2 includes two hub assemblies 118, each of which is slid over the upper end of a respective post 108 and connected thereto with fasteners. Each hub assembly 118 of the illustrated example includes an upper housing 120 comprising an inner cover 122 connected to an outer cover 124, a lower housing 130 having an inner cover 132 connected to an outer cover 134, and first and second links 140, 142 pivotally connected at axes 126 to the upper housing 120 and pivotally connected at axes 128 to the lower housing 130. Each inner cover 132 of a lower housing 130 further includes a pair of mounting recesses 138. The carrier assembly 116 further includes a pair of control bars 150 the opposite ends of which are received by and connected to the respective mounting recesses 138 in the inner covers 132 of the opposed lower housings 130. The two control bars 150 of the example carrier assembly 116 of FIG. 2 also are connected to each other by a bracket 152. The bracket 152 provides a means for connecting to a drive mechanism.

In the illustrated example, the hub assemblies are mirror images of one another. Thus, for ease of discussion, the following description will refer to one hub assembly 118, but the reader will understand that the description of one hub assembly 118 is likewise applicable to the second hub assembly 118. The axes 126 at the upper ends of the links 140, 142 of the hub assembly 118 are closer together than the axes 128 at the lower ends of the links 140, 142. The pivotal connection of the first and second links 140, 142 to the upper housing 120 and the lower housing 130 within each hub assembly 118 provides a four bar linkage or trapezoidal structure that permits a reciprocating or oscillating back-and-forth motion that simulates an arc of a very large radius. The trapezoidal alignment of the upper pair of axes 126 and lower pair of axes 128 causes the movement that simulates an arc of very large radius, and together with gravity, tends to impart a lowest point of travel or self-centering feature of the carrier assembly 116. It also permits a relatively large amount of horizontal translation with very little vertical displacement throughout the reciprocating motion of the carrier assembly 116. The small vertical displacement of the mass of the loaded sleeping compartment 12 avoids the need for significant power to lift the bassinet and, thus, permits use of a direct drive reciprocating motion.

The direct drive mechanism of the illustrated example pushes and pulls the bassinet 12 via the control bars 150 of the carrier assembly 116. This pushing and pulling is accomplished by locating the drive unit 114 beneath the bassinet 12 and connecting a drive unit link 154 to the bracket 152 between the control bars 150 of the carrier assembly 116. The drive unit 114 of the illustrated example has a housing 160 that is connected atop the upper bar 110 via the bracket 112. This relatively central connection of the drive unit 114 to the carrier assembly 116 helps prevent undesirable twisting of the carrier assembly 116 of the sleeping compartment support 100 as a result of, for example, a torquing force that would be applied by a non-centrally located drive mechanism.

Figure 3:
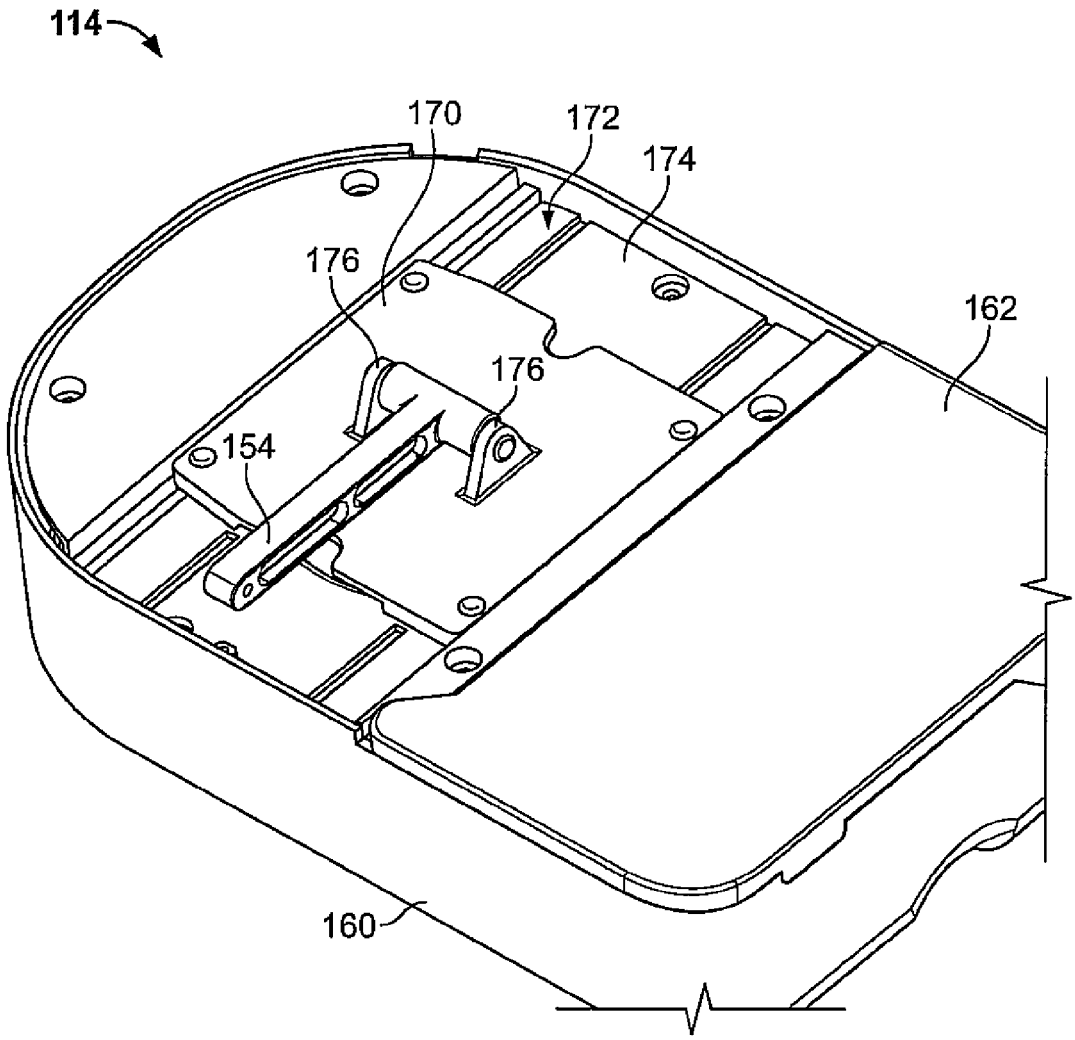
FIG. 3 is a perspective view of an example drive mechanism for the example sleeping compartment support shown in FIG. 1, shown with a central cover removed.

Turning to FIGS. 3-6, in the illustrated example, the housing 160 opens upward and is enclosed by a first cover 162 that covers a battery compartment 164 (batteries not shown), and by a second cover 166 that covers a drive train 168. As best seen in FIG. 3, with the second cover 166 removed from the drive unit 114, a yoke plate 170 is exposed. The yoke plate 170 is dimensioned to slide back-and-forth within a track 172 of an upper housing portion 174. The upper side of yoke plate 170 has two upstanding flanges 176. As seen in FIG. 2, the flanges 176 extend through the second cover 166 and are pivotally connected to a drive unit link 154. The drive unit link 154 may be connected to the bracket 152 to thereby provide a reciprocating direct drive connection between the drive unit 114 and the control bars 150, and, thus, the bassinet 112.

Figure 4:
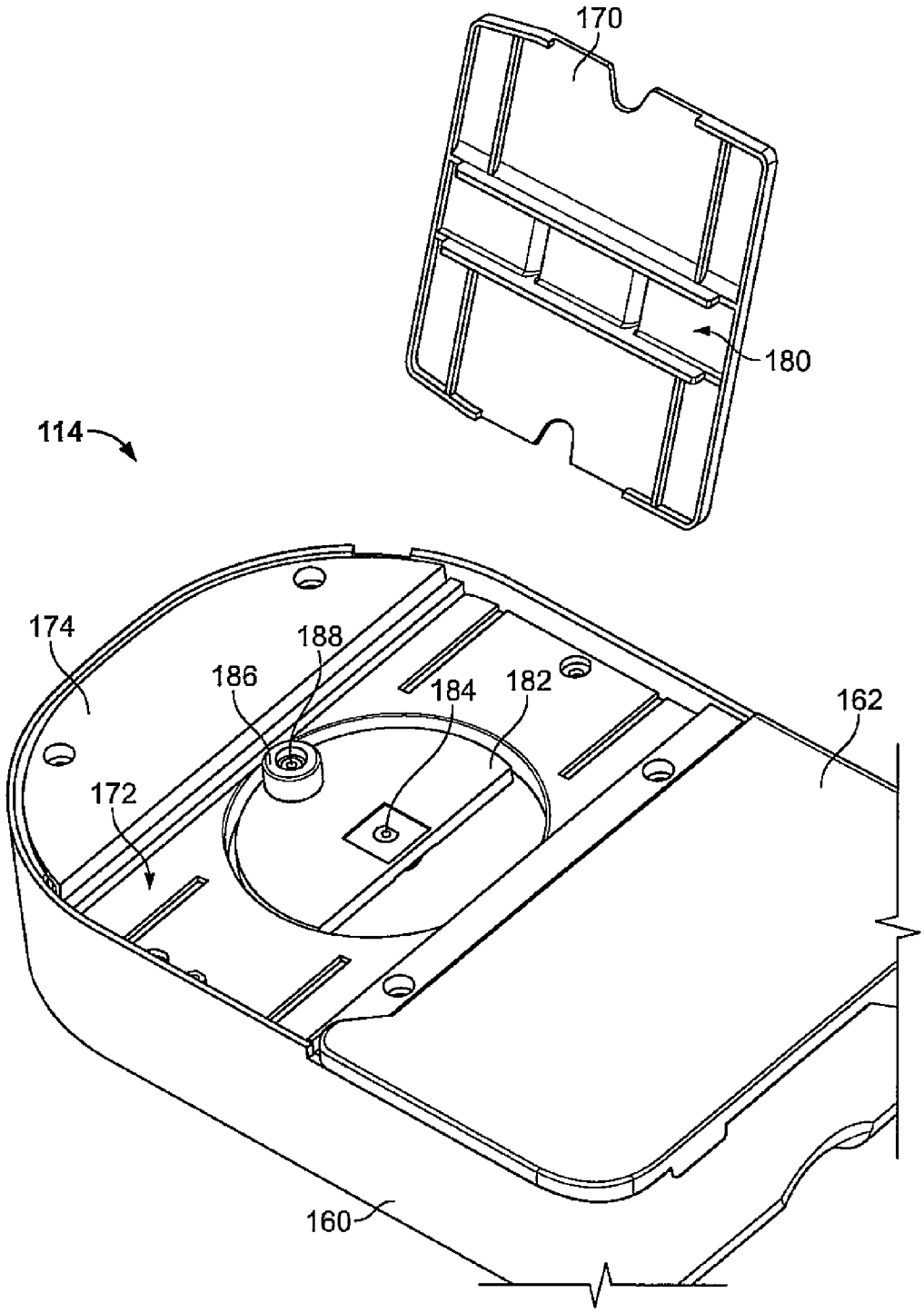
FIG. 4 is a perspective view of the example drive mechanism shown in FIG. 3, with a yoke plate lifted away to expose a drive roller.

In FIG. 4, the example yoke plate 170 has been lifted from the drive unit 114, exposing a track 180 on the underside of the yoke plate 170. The track 180 of the illustrated example yoke plate 170 has an axis that is perpendicular to an axis of the track 172 in which the yoke plate 170 slides. A disk portion 182 that is rotatably connected to a drive shaft 184 also is exposed in FIG. 4. A roller 186 is rotatably connected to the disk portion 182 on an axle 188 that is spaced from the drive shaft 184. The roller 186 is dimensioned to fit within the track 180 on the underside of yoke plate 170 so as to form a double slider crank or Scotch yoke drive mechanism. By this drive mechanism, it will be appreciated that the rotary motion of the drive shaft 184 is transmitted through the disk portion 182 to the roller 186. The offset of the axle 188 from drive shaft 184 provides an eccentric path for the roller 186 which rolls within the track 180 on the underside of the yoke plate 170 along a first axis which is perpendicular to the axis of sliding travel of the yoke plate 170 within the track 172. The eccentric path of the roller 186 thereby causes the yoke plate 170 to be driven back-and-forth in a sliding motion in the track 172 as the disk portion 182 rotates.

Figure 5:
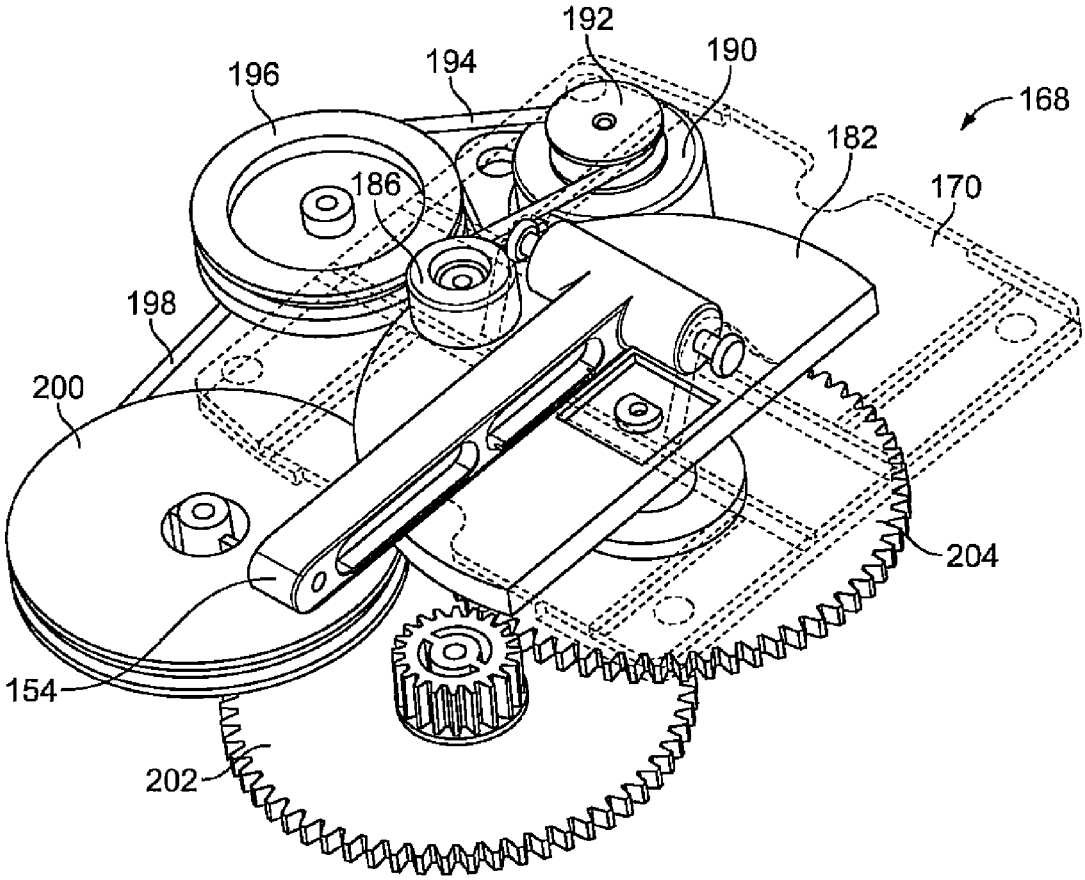
FIG. 5 is a perspective view of an example drive train for the drive mechanism shown in FIG. 3, with the yoke plate shown in phantom.
Figure 6:
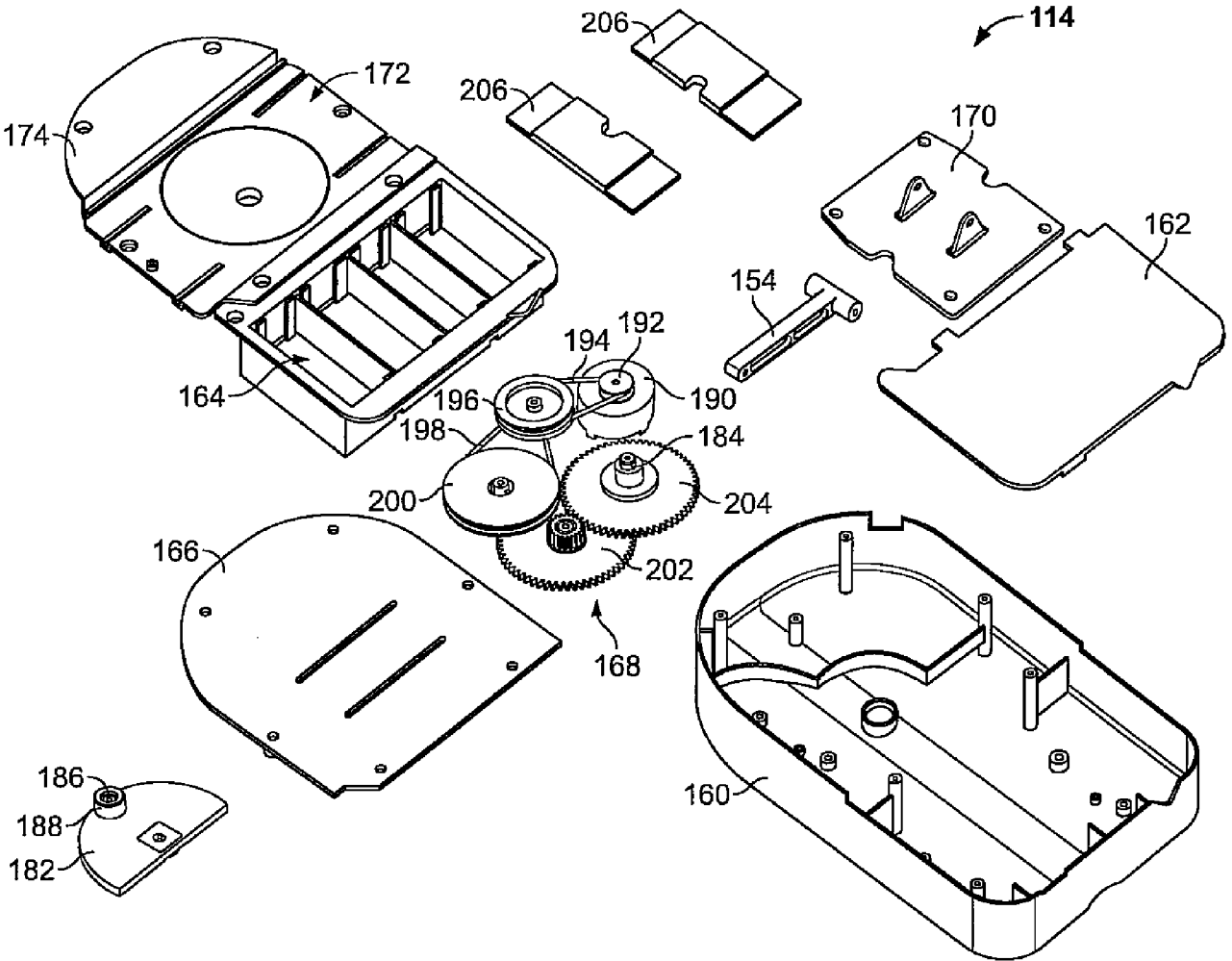
FIG. 6 is an exploded perspective view of the example drive mechanism shown in FIG. 3.

In the illustrated example as shown in FIGS. 5 and 6, the drive train 168 of the drive unit 114 includes significant gear reduction. The illustrated example drive train 168 uses both gears and drive belts for noise reduction. A small, battery operated motor 190 is connected to, and selectively rotates, a small diameter initial drive pulley 192. A first elastomeric drive belt 194 connects the initial drive pulley 192 to a first relatively larger input pulley of a secondary drive pulley assembly 196 to thereby transmit a drive force and provide a first gear reduction. A second, relatively smaller output pulley (not shown), is located beneath the secondary drive pulley assembly 196. A second elastomeric drive belt 198 connects the second, relatively smaller, output pulley of the secondary drive pulley assembly 196 to a relatively larger input pulley of a tertiary drive pulley assembly 200 to thereby transmit a drive force and a provide a further gear reduction. The tertiary drive pulley assembly 200 also has a relatively smaller output gear (not shown), located beneath the illustrated pulley. The relatively smaller output gear of the tertiary drive pulley assembly 200 engages a first relatively larger input gear of a quarternary drive pinion 202 to thereby transmit a drive force and provide a further gear reduction. The quarternary drive pinion 202 also has a second relatively smaller output gear that engages a first relatively larger input gear of a final drive pinion 204 to thereby transmit a drive force and provide yet a further gear reduction. The drive shaft 184 is connected to the final drive pinion 204 and passes through shields 206 and upper housing portion 174. The disk portion 182 is connected to the distal end of the drive shaft 184. The roller 186 is connected to the disk portion 182 such that the drive force is conveyed to the yoke plate 170 as above explained. In the illustrated example, the multi-stage gear reductions provided by the pulley and gear combinations collectively provide an overall gear reduction of approximately 200:1. The relatively high speed, low torque battery operated motor 190 is able to provide sufficiently powerful, direct, reciprocating pushing and pulling drive motion to drive link 154 while it is pivotally connected to the yoke plate 170.

When the sleeping compartment support 100 is assembled, an enclosure, such as in the form of the bassinet 12, may be placed atop and connected to the carrier assembly 116 by engaging the connectors 22 on the underside of the bottom panel 18, whereby each connector 22 straddles a control bar 150 of the carrier assembly 116. The bassinet 12 then may be used in a stationary mode, or if desired, may be rocked automatically by engaging the drive unit 114. The bracket 152 is configured to permit removable connection of the drive unit 114 via the link 154. Thus, the drive unit 114 may be connected to the carrier assembly 116 by connecting the link 154 to the bracket 152. The drive unit 114 may be operated by a remote control unit 210 which is shown in FIG. 2 as being removably connectable to a side of the bassinet 12. It will be appreciated that the control unit 210 alternatively may be a handheld remote control unit and/or constructed to connect to another portion of the assembly 10. Also, the control unit 210 may be linked to the drive unit 114 wirelessly or by conventional wire connections. Additionally, as an alternative, the drive unit 114 may have controls incorporated directly into the drive unit housing 160, or otherwise conveniently configured. It also will be appreciated by those of ordinary skill in the art that the control unit 210 also may be made to operate the drive unit 114 at more than one selected speed.

While the present disclosure shows and demonstrates various example supports 100 and sleeping enclosures 12 that are adapted to provide gentle, substantially planar, reciprocating motion for a sleeping child, these examples are merely illustrative and are not to be considered limiting. It will be apparent to those of ordinary skill in the art that various sleeping compartment supports and/or sleeping enclosures can be constructed without departing from the scope or spirit of the present disclosure. Thus, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus comprising:

a support comprising a base and a carrier assembly hung from the base; and a drive unit connected to the base and to the carrier assembly, the drive unit comprising a motor and a slider crank assembly coupled below the carrier assembly to provide reciprocating motion to the carrier assembly relative to the base, the slider crank assembly including a disk rotatably driven by the motor, a roller eccentrically mounted to the disk, and a yoke plate for reciprocating movement along a first track, the yoke plate including a second track, the second track being perpendicular to the first track, the roller mounted within the second track to convert the rotation of the disk into translation of the yoke plate.

2. An apparatus as defined in claim 1, wherein the carrier assembly is dimensioned to removably receive a child support.

3. An apparatus as defined in claim 1, wherein the drive unit is removably coupled to the carrier assembly.

4. An apparatus as defined in claim 1, wherein the child support further comprises at least one of a bassinet, cradle or crib.

5. An apparatus as defined in claim 1, wherein the carrier assembly further comprises a linkage connected to the base.

6. An apparatus as defined in claim 5, wherein the linkage further comprises a four bar linkage.

7. An apparatus as defined in claim 6, wherein the four bar linkage further comprises a stationary housing, a movable housing and a pair of links, each link of the pair of links being pivotally connected to the stationary housing and to the movable housing.

8. An apparatus as defined in claim 7, wherein the links hang downward from the stationary housing.

9. An apparatus as defined in claim 7, wherein a first link of the pair of links is pivotally connected to the stationary housing via a first pivot axis and is pivotally connected to the movable housing via a second pivot axis, a second link of the pair of links is pivotally connected to the stationary housing via a third pivot axis and is pivotally connected to the movable housing via a fourth pivot axis, the first pivot axis and the third pivot axis are separated a first distance, the second pivot axis and the fourth pivot axis are separated a second distance, the first distance is less than the second distance.

10. An apparatus as defined in claim 1, wherein the drive unit further comprises a plurality of pulleys, a drive belt and a gear.

11. An apparatus as defined in claim 1, wherein the motor comprises a battery operated rotary motor.

12. An apparatus as defined in claim 1, wherein the base further comprises a pair of upstanding posts with each post connected to a ground engaging support.

13. An apparatus as defined in claim 1, wherein the carrier assembly is configured to support a sleeping compartment approximately 30 inches above a ground surface.

14. An apparatus as defined in claim 1, wherein the carrier assembly moves in a substantially flat arcuate path.

15. An apparatus as defined in claim 1, further comprising a remote control unit operationally connected to the drive unit.

16. An apparatus comprising:

a support comprising a base and a carrier assembly hung from the base; and a drive unit connected to the base and to the carrier assembly, the drive unit comprising a motor and a slider crank assembly coupled below the carrier assembly to provide reciprocating motion to the carrier assembly relative to the base, wherein the drive unit further comprises a rotatably mounted crank having an eccentrically located roller that engages a track in a yoke plate, and wherein rotation of the crank is converted to translational movement of the yoke plate and the yoke plate does not rotate.

17. An apparatus as defined in claim 16, wherein the carrier assembly is hung from the base via a four bar linkage that includes an upper bar, a lower bar, a first bar and a second bar, the first bar is pivotally coupled to the upper bar via a first pivot axis and is pivotally coupled to the lower bar via a second pivot axis, the second bar is pivotally coupled to the upper bar via a third pivot axis and is pivotally coupled to the lower bar via a fourth pivot axis, the first pivot axis and the third pivot axis are separated a first distance, the second pivot axis and the fourth pivot axis are separated a second distance, the first distance is less than the second distance.

18. An apparatus comprising:

a support comprising a base and a carrier assembly hung from the base; and a drive unit connected to the base and to the carrier assembly, the drive unit comprising a motor and a slider crank assembly coupled below the carrier assembly to provide reciprocating motion to the carrier assembly relative to the base, wherein the drive unit further comprises: a first pulley; a second pulley coupled to the first pulley; a third pulley coupled to the second pulley; a first gear coupled to the third pulley; a second gear coupled to the first gear; a roller coupled to the second gear; a track coupled to the roller wherein the roller moves along a first axis with respect to the track; and wherein rotation of the first pulley is converted to translational movement substantially along an axis perpendicular to the first axis.

19. An apparatus as defined in claim 18, wherein the carrier assembly is hung from the base via a four bar linkage that includes an upper bar, a lower bar, a first bar and a second bar, the first bar is pivotally coupled to the upper bar via a first pivot axis and is pivotally coupled to the lower bar via a second pivot axis, the second bar is pivotally coupled to the upper bar via a third pivot axis and is pivotally coupled to the lower bar via a fourth pivot axis, the first pivot axis and the third pivot axis are separated a first distance, the second pivot axis and the fourth pivot axis are separated a second distance, the first distance is less than the second distance.

20. A child sleeper comprising:

a sleeping compartment;

a support comprising a base and a carrier assembly hung from the base, the carrier assembly being hung from the base via a four bar linkage that includes an upper bar, a lower bar, a first bar and a second bar, the first bar being pivotally coupled to the upper bar via a first pivot axis and being pivotally coupled to the lower bar via a second pivot axis, the second bar being pivotally coupled to the upper bar via a third pivot axis and being pivotally coupled to the lower bar via a fourth pivot axis, the first pivot axis and the third pivot axis being separated a first distance, the second pivot axis and the fourth pivot axis being separated a second distance, the first distance is less than the second distance;

a motor;

and a slider crank assembly below the carrier assembly to provide reciprocating motion to the carrier assembly relative to the base.

21. An apparatus as defined in claim 20, wherein the four bar linkage forms a trapezoid.

22. An apparatus as defined in claim 20, wherein one or more of the first bar, the second bar, the upper bar or the lower bar are curved.

* * * * *